US005332210A

United States Patent [19]

Silverberg et al.

[11] Patent Number: 5,332,210

[45] Date of Patent: Jul. 26, 1994

[54] VARIABLE SIZE ENVELOPE DROP STACKER HAVING MEANS FOR ASSURING ENVELOPE SEALING

[75] Inventors: Morton Silverberg, Westport; Steven A. Supron, New Haven, both of Conn.

[73] Assignee: Pitney Bowes Inc., Stamford, Conn.

[21] Appl. No.: 978,011

[22] Filed: Nov. 18, 1992

[51] Int. Cl.[5] ..... B65H 31/26

[52] U.S. Cl. ..... 271/220; 271/224

[58] Field of Search ..... 271/220, 207, 224, 241, 271/177, 188

[56] References Cited

U.S. PATENT DOCUMENTS

| | | | |
|---|---|---|---|
| 1,086,353 | 2/1914 | Dick | 271/220 |
| 3,860,127 | 1/1975 | Fassman | 214/6 N |
| 4,441,702 | 4/1984 | Nagel et al. | 271/177 |
| 4,838,539 | 6/1989 | Zimmermann | 271/220 X |
| 5,022,638 | 6/1991 | Ifkovits, Jr. | 271/2 |

FOREIGN PATENT DOCUMENTS

| | | | |
|---|---|---|---|
| 60-19640 | 1/1985 | Japan | 271/207 |
| 789015 | 1/1958 | United Kingdom | 271/220 |

*Primary Examiner*—David H. Bollinger

*Attorney, Agent, or Firm*—Charles G. Parks, Jr.; Melvin J. Scolnick

[57] ABSTRACT

The envelope drop stacking apparatus receives envelopes ejected from a mailing machine in a seriatim manner to the stacker. The mailing machine ejects envelopes from an exist along an exist plane to which the drop stacker entrance is aligned. The stacker has an elongated deck extending generally parallel to and vertically below the exist plane and an elongated registration wall extending vertically from the deck and lateral to the exist. A bi-sectional deflector strip has at one end pivotally mounted to the registration wall vertically elevated above the exist plane. A skew section translates the first section of the deflector section to the second section to produce a negative skew of the second section relative to the exist plane. The deflector strip is located to cause the deflector strip's second section to encounter an ejected envelope's leading edge and thereby produces a negatively skewed envelope trajectory. This trajectory is calculated to cause the envelope to be registered against the registration wall.

6 Claims, 4 Drawing Sheets

VARIABLE SIZE ENVELOPE DROP STACKER HAVING MEANS FOR ASSURING ENVELOPE SEALING

BACKGROUND OF THE INVENTION

The present invention relates to flat processing systems and, more particularly, drop stackers for collecting envelopes processed by a envelope mail system.

Conventional drop stackers are intended to collect envelopes processed by a mail processing system and delivered to the drop stacker in a seriatim manner. In a novel mail processing system, the processing system includes a feeder section having a non-contact moistener and a mailing machine which receives envelopes from the feeder section. The feeder section includes several modules. The first module is a hopper which receives a stack of mixed sized mail, sealed and unsealed, and flapped and unflapped. A singulator module separates the stacked envelopes and seriatimly delivers the envelopes to a moistener feeder section. It is the function of the moistener section to moisten the flap area of unsealed envelopes. After flap moistening, the envelope is passed to a mailing machine where the envelope is optionally weighed and printed with a postage indicia. After posting of the envelope, the envelope is ejected into a stacker for collection. One such stacker is referred to as a drop stacker.

It has been empirically observed that when employing a conventional drop stacker with the novel mail processing system, the ejection of the envelope stream into the drop stacker has exhibited a shingling problem in which the flaps of adjacent envelopes becoming glued together. This is the result of the flaps being able to open during their flight path and being able to get between the previously stacked envelopes and the rear wall. The ability of the envelope flaps to open is seen to be largely a consequence of the high processing speed of the mail processing system. The envelope sealing glue does not have sufficient time and contact with the opposite surface to become sufficiently tacky to hold the envelope flap closed by the time that the envelope is delivered to a stacker. Consequently, the stacker has to accomplish four functions. One is to assure that the hinge line of each envelope added to the stack is registered against the registration wall to minimize the opportunity for a following envelope flap to slip between the stack and the registration wall. A second is to provide for limiting the maximum angle the flap has a chance to open to less than 90 degrees. A third is to be able to close the flat against the resistant spring forces trying to open the flap. Lastly, the force must be provided to hold the flap closed and in contact with the mating portion of the envelope while sufficient adhesion is developed.

SUMMARY OF THE INVENTION

It is an objective of the present invention to present a drop stacker having deflector means which promotes envelope sealing.

It is a further objective of the present invention to present a drop stacker having unique surfaces which overcome the problem of mis-shingling.

The drop stacker has a receiving hopper having a registration wall, base and longitudinally adjustable rear-wall. The base includes a deck which is set at a recline of approximately 12° degrees from the horizontal. The registration wall is set at a recline of approximately 15° from the vertical. Also, the adjustable rear wall is set at a skew of approximately 5° degrees with angle of end recline of approximately 2.5° degrees. The hopper further includes an angled ramp set at an uphill angle of approximately 25° degrees to the direction of the incoming mail and having a skew of approximately 5° degrees. A cushioning and impact absorbing material is mounted onto the adjustable end-wall.

A deflector or guide is pivotally mounted at one end to the forward end of the hopper registration wall. The deflector is set at an angle of approximately 15° degrees relative to the perpendicular of the registration and has, a formed abrupt skew angle of approximately 10° degrees. The other end of the deflector initially rests on the uphill angled ramp, and during the operation, on the top envelope in the accumulating stack. The relative alignment of the deflector causes the leading edge of incoming larger envelopes to assume a skewed flight angle directing the envelope towards the registration wall. Registration of each incoming envelope hinge line against the registration wall is also strongly driven by the angled impact with the adjustable end-wall. The outer corner of each envelope contacts the impact absorbing cushioned surface and induces a torque which serves to kick the envelope toward the registration wall. This action is also facilitated by the 12° degree backwards angle of the base.

The pivoting deflector also serves to direct the incoming envelope lead edge to the intersection of its resting tip and the accumulating stack. It is important that the envelope be able to wedge itself under and beyond the tip of the deflector. This action serves many functions. One is to slow the envelope prior to its impact with the impact wall and limit the bounce back from this impact. Even more significantly, the act of the envelope wedging under the deflector tip provides for closing the envelope flap and holding the envelope flap closed against the tendency of the flap to spring open. This is vital that the downward force and weight of the pivoting deflector be chosen to balance the need to be light enough to be wedged open by a light weight envelope and yet heavy enough to hold a springy flap closed while the glue develops sufficient adhesion. The action of a proper weighted pivoted deflector to close envelope flaps and hold them closed is also a valuable action in other envelope top stacking geometries.

DETAILED DESCRIPTION OF THE PREFERRED EMBODIMENT

Figure 1:
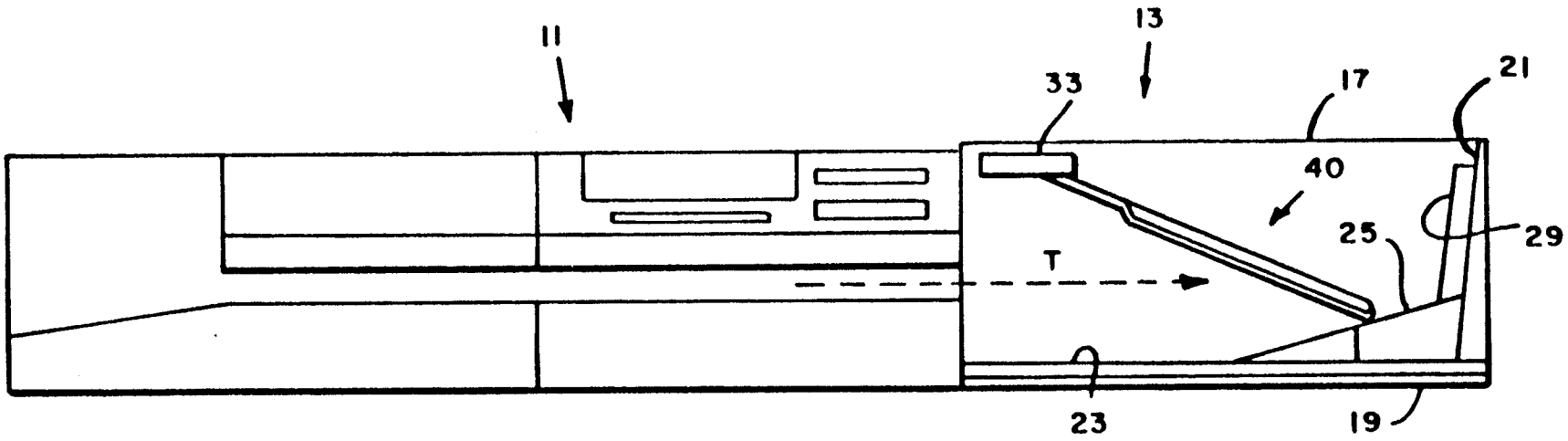
FIG. 1 is a side view of a mail processing system having an associated drop stacker in accordance with the present invention.
Figure 2:
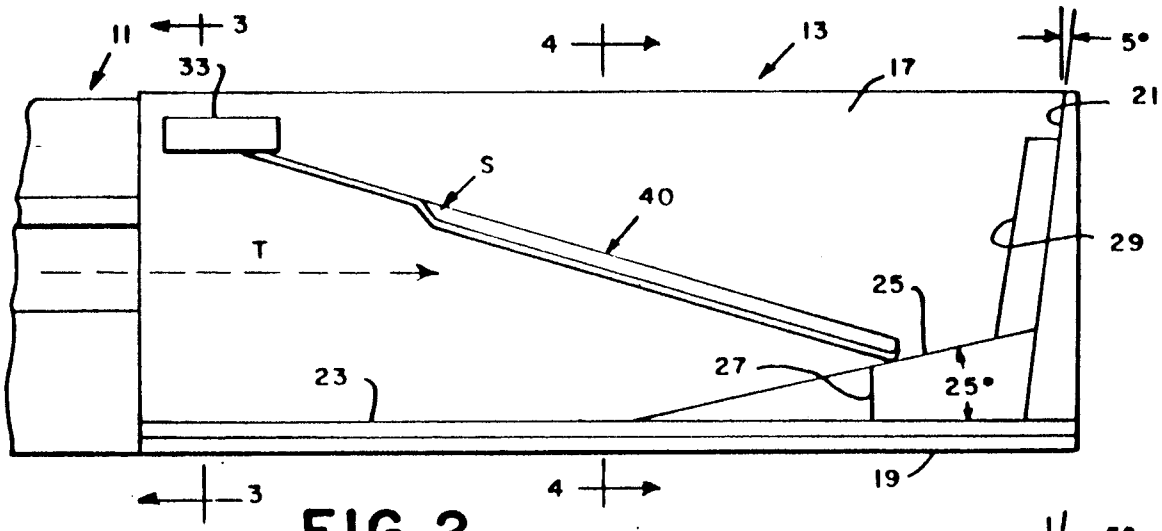
FIG. 2 is a partial side view of the mail processing system and drop stacker in accordance with the present invention.

Referring to FIGS. 1 and 2, in the preferred environment, a postage meter mailing machine, generally indicated as 11, is aligned to a drop stacker, generally indicated as 13. The postage meter mailing machine 11 in the most preferred environment is designed to process a seriatim stream of envelopes of mixed size, and flapped and unflapped mail. Mail processing primarily encompasses singulating an envelope from an envelope stack, sealing the unflapped envelope, weighing the envelope and posting the envelope with the proper postage according to the envelope weight. Once the envelope is properly posted, the envelope is ejected from the mailing machine 11 into the drop stacker 13 in the direction indicated by arrow "A" for collection. A detailed description of the preferred mail processing system is presented in U.S. Pat. No. 4,935,078, High Throughput Mailing Machine Timing, commonly assigned.

Figure 4:
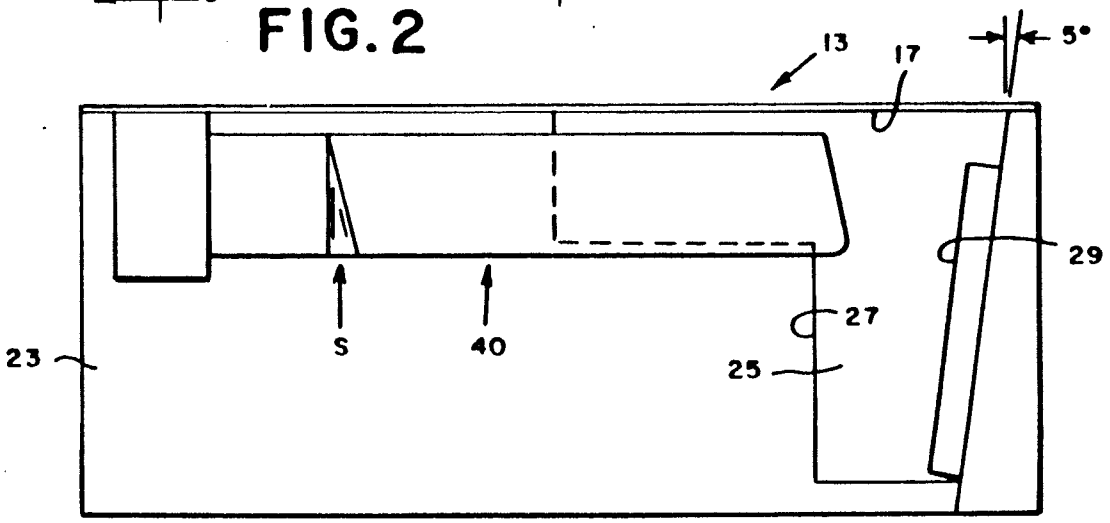
FIG. 4 is a section end of the drop stacker taken along line 4—4 of FIG. 2.
Figure 3:
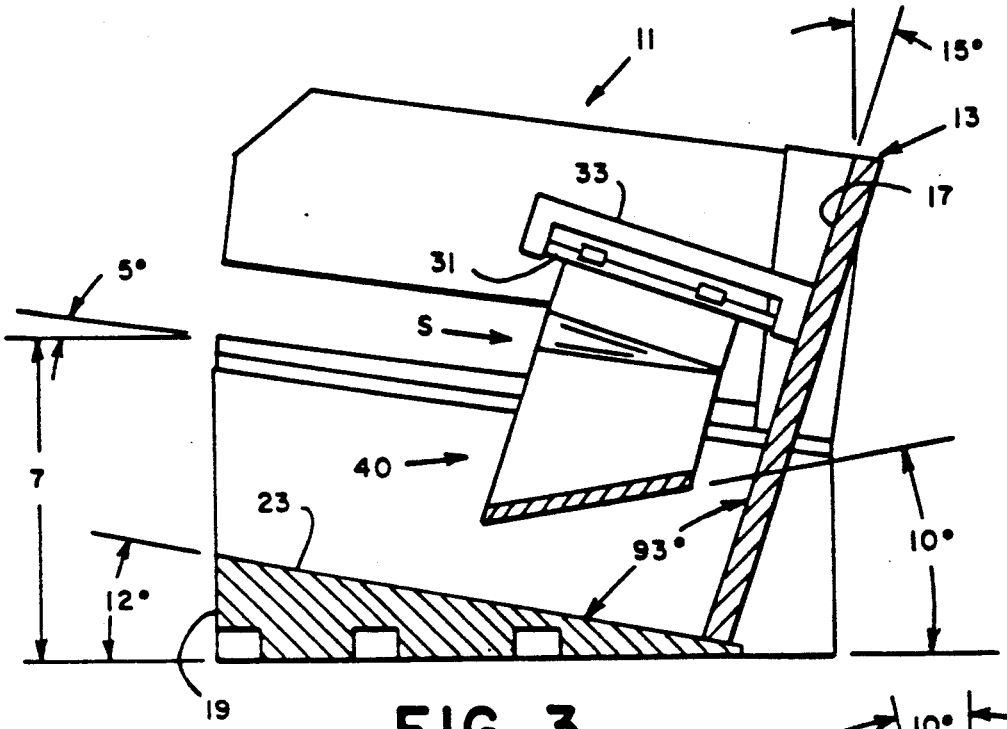
FIG. 3 is a sectioned end view of a drop stacker taken along line 3—3 of FIG. 2 in accordance with the present invention aligned to the ejection end of a mailing machine.
Figure 5A:
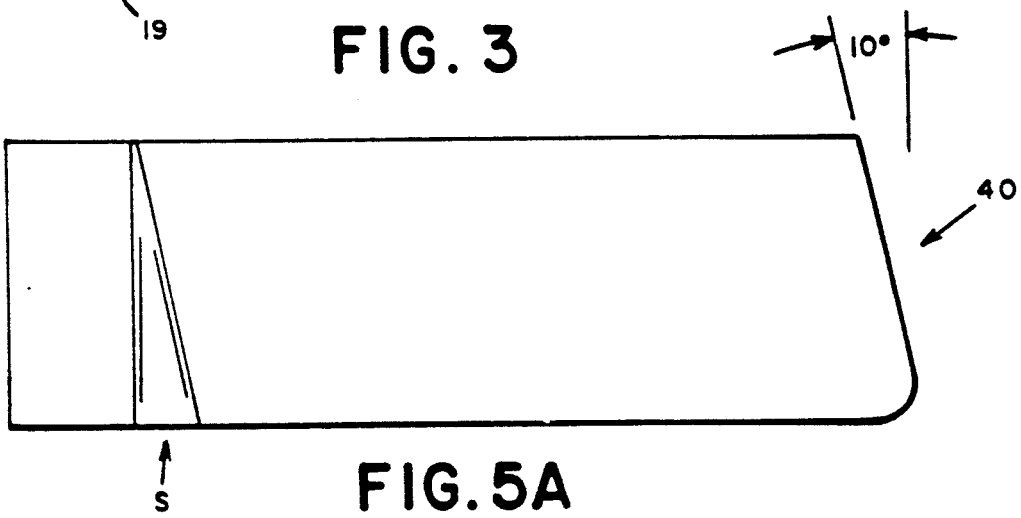
FIG. 5A is a top view of a deflector in accordance with the present invention.
Figure 5B:
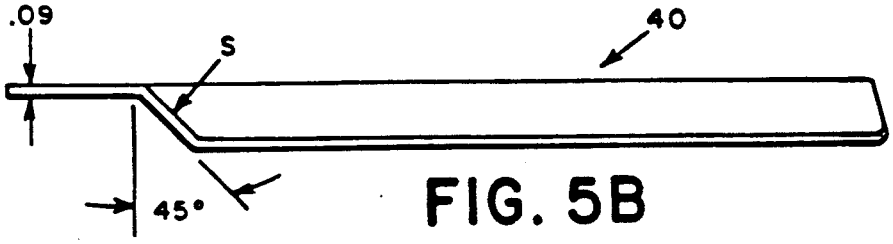
FIG. 5B is a side view of the deflector in accordance with the present invention.
Figure 5C:
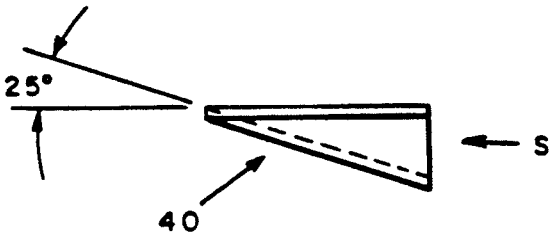
FIG. 5C is a sectioned view of the skew area of the deflector.

Referring to FIGS. 2 and 4, the drop stacker 13 includes a registration wall 17, base 19 and longitudinally adjustable rear-wall 21. The base 19 includes a elongated support deck 23 which is reclined approximately 12° degrees from the horizontal towards the registration wall 17. The registration wall 17 is set at a recline of approximately 15° from the vertical such that the angle between the deck 23 and registration wall 17 is approximately 92° degrees. The rear wall 21, preferably, is adjustably mounted to the base 19 by any suitable conventional means, however for the purpose of clarity the rear wall 21 is shown as fixably mounted to the base 19. The rear wall 21 is set at an angle of 5° degrees with a vertical skew of approximately 5° degrees. The drop stacker 13 further includes an angled ramp 25 set at an uphill angle of approximately 25° degrees to the direction of the incoming mail and having a skew of approximately 5° degrees. In the preferred embodiment, the impact ramp 25 has a cut-out portion, generally indicated as 27, to allow easy removal of collected envelopes 15. A cushioned impact pad 29 made from any suitable material is mounted to the end wall 21 of the hopper.

Referring to FIGS. 3, 5A, 5B and 5C, a hub 31 and covering shroud 33 are fixably mounted to the forward end of the registration wall 17 by any conventional means. The hub 31 extends perpendicular to the registration wall 17 One end of a deflector 40 is pivotally mounted to the hub by any suitable conventional means such as by formed circular tabs. The deflector 40 is set at an angle of approximately 15° degrees relative to the perpendicular of the registration and has a formed abrupt skew angle of approximately 10° degrees at a position "S" along its length. It has been empirically determined that a skew angle be between negative 5° and positive 15°, preferably 20°. It is noted that the position "S" is located above the incoming trajectory of an envelope 15 ejected from the mail processing system. The other end of the deflector 40 rests on the impact ramp 25. The relative alignment of the deflector 40 causes the leading edge of incoming larger envelopes 15 to assume a skewed flight angle directing the envelope 15 towards the registration wall 17. Full registration is further assisted by the skew of the impact ramp 25 and recline angle of the base 19. Registration of smaller envelopes 15 and card is promoted by the skew of the ramp 25 and recline of the base 19.

It has been empirically determined that in the preferred embodiment the deflector 40 is made from lexan or other plastic having base 19 dimensions of 0.09 inches thick by 3.0 inches width by 11 inches length and has a weight within the range of 1.5 ounces to 3 ounces, preferably of approximately 2.2 ounce.

Figure 6:
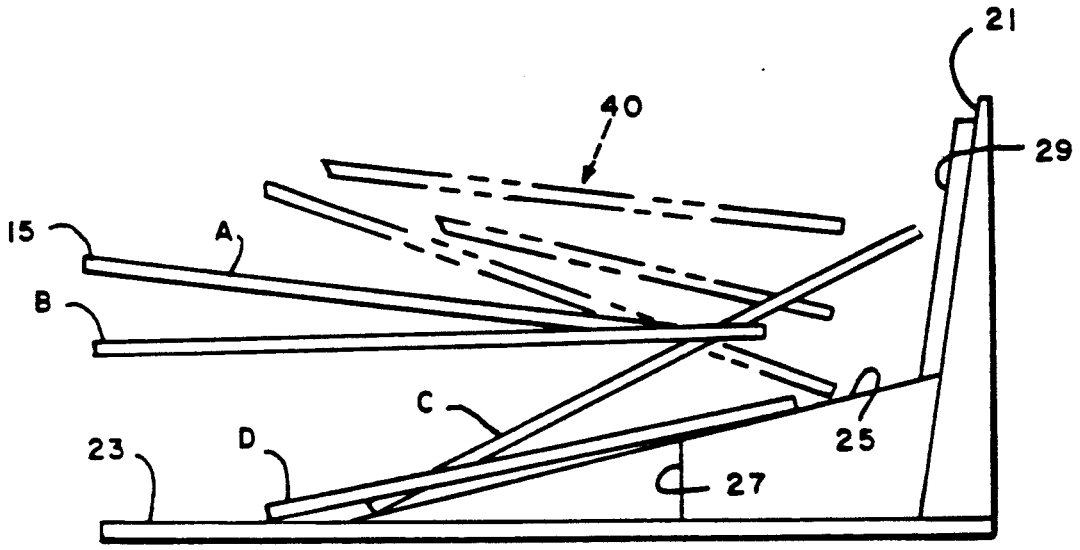
FIG. 6 is a schematic of flight path of a larger envelope as it encounters the deflector.

Referring to FIGS. 1, 2 and 6, a leading edge of a large envelope 15 ejected from the mailing machine 11 travels along an initial trajectory indicated by the arrow "T". The trajectory of the envelope 15 causes the envelope leading edge to encounter the deflector 40 approximately 1" below its ejection line indicated as position "A" in FIG. 3. The ejection velocity of the mailing machine 11's ejected envelope is sufficiently high such that contact between the leading edge of the envelope 15 and the deflector 40 causes the deflector 40 to deflect archly aside, indicated as positions "B" and subsequent position "C" in FIG. 6. Because of the deflector 40 skew, the reaction force on the envelope 15 skews the envelope 15 trajectory in the direction of the registration wall 17. The envelope 15 thereafter encounters the registration wall 17 in full registration and slides down along the ramp 25 to assume a rest position below the deflector 40, indicated as position "D" in FIG. 6. Smaller envelopes 15 generally will not have enough momentum to encounter the deflector 40 and, upon ejection, come to rest on the ramp 25 wherein the ramp skew produces registration.

The afore represents the preferred embodiment of the present invention and should not be viewed as limiting. The scope of the invention is defined by the appendix claims.

What is claimed is:

1. An improved envelope stacking apparatus for receiving envelopes ejected from a mail processing apparatus in a seriatim manner to said stacking apparatus. said mail processing apparatus to eject said envelopes from a exist along an exist plane, said stacking apparatus having an entrance aligned to said mail processing apparatus exist, wherein the improvement comprises:

said stacker having an elongated deck extending generally parallel to and vertically below said plane, and an elongated registration wall extending vertically from said deck and lateral to said exist;

a bi-sectional deflector strip, having a first end pivotally mounted to the registration wall vertically elevated above said exist plane and locating a first section, a skew section translating said first section to a second section and producing a negative skew of said second section relative to said exist plane;

said deflector located for encountering said envelope's leading edge ejected upon ejection of said envelope from said apparatus along said plane, said encounter of said envelope with said second section of said deflector strip to cause a resulting load on said envelope and thereby negatively skewing the trajectory of said envelope to cause said envelope to be registered against said registration wall;

said skew section being set at a negative 5° to 15° skew;

said deflector strip having a weight between 1.5 ounces and 3.0 ounces, and;

said exist plane is set at a angle of between 90° to 110° relative to said registration wall, said registration wall be set at an angle of between 90° and 95° relative to said deck and said deck be set at an angle of 5° relative to the horizontal.

2. An improved envelope stacker as claimed in claim 1 further having an end wall fixably mounted to said deck and extending vertically therefrom and extending laterally to said registration wall and having a skew of between 2.5 and 7.5 degrees towards said registration wall.

3. An improved envelope stacker as claimed in claim 2 having an envelope ramp fixably mounted to said deck having a ramp angle toward said end wall of between 15 and 35 degrees and a skew angle of between 2.5 and 7.5 degrees, said ramp to have a longitudinal extension to said end wall and a lateral extension to said registration wall.

4. An improved envelope stacker as claimed in claim 3 wherein said deflector weights between 1.5 ounces and 3.0 ounces.

5. An improved envelope stacker as claimed in claim 3 wherein said exist plane is set at a angle of between 90 to 110 degrees relative to said registration wall, said registration wall be set at an angle of between 90 and 95 degrees relative to said deck and said deck be set at an angle 5 degrees relative to the horizontal.

6. An improved envelope stacker as claimed in claim 5 wherein said deflector weights between 1.5 ounces and 3.0 ounces.

* * * * *